US005480609A

United States Patent [19]

Dupoiron et al.

[11] Patent Number: 5,480,609

[45] Date of Patent: Jan. 2, 1996

[54] AUSTENITIC STAINLESS STEEL WITH HIGH RESISTANCE TO CORROSION BY CHLORIDE AND SULPHURIC MEDIA AND USES

[75] Inventors: François Dupoiron, Le Creusot; Jean-Christophe Gagnepain, Lyons; Michel Verneau, Le Creusot, all of France

[73] Assignee: Creusot-Loire Industrie, Puteaux, France

[21] Appl. No.: 250,687

[22] Filed: May 27, 1994

[30] Foreign Application Priority Data

May 28, 1993 [FR] France ..... 93 06468

[51] Int. Cl.[6] ..... C22C 38/44; C22C 38/42; C22C 30/00

[52] U.S. Cl. ..... 420/45; 420/46; 420/47; 420/586.1; 420/584.1

[58] Field of Search ..... 420/45, 46, 47, 420/586.1, 584.1

[56] References Cited

U.S. PATENT DOCUMENTS 4,302,247 11/1981 Abe et al. ..... 420/46
4,765,957 8/1988 Culling ..... 420/586.1

*Primary Examiner*—Deborah Yee
*Attorney, Agent, or Firm*—Oblon, Spivak, McClelland, Maier & Neustadt

[57] ABSTRACT

The steel contains, in proportions by weight, from 20 to 30% of chromium, from 25 to 32% of nickel, from 3 to 7% of molybdenum, from 0.35 to 0.8% of nitrogen, from 0.5 to 5.4% of manganese, up to 0.06% of carbon and up to 1% of silicon. Because of its multifariousness of corrosion resistance the steel can be employed in particular for the manufacture of equipment for removing pollutants from fumes, of equipment for the paper pulp industry, for the chemical industry or for petroleum exploitation, for seawater plants and for the manufacture of tankers for transporting corrosive products. The steel has a very high structural stability.

6 Claims, No Drawings

AUSTENITIC STAINLESS STEEL WITH HIGH RESISTANCE TO CORROSION BY CHLORIDE AND SULPHURIC MEDIA AND USES

The present invention relates to an austenitic stainless steel with high mechanical strength and high corrosion resistance.

Stainless steels with high mechanical strength and high resistance to corrosion in chloride media and sulphuric media or even in media which are at the same time chloride-containing and sulphuric, are employed for the manufacture of equipment intended especially for the purification of fumes from thermal electrical power stations or intended for oil platforms working in contact with seawater and media containing acidic gases or else for the manufacture of paper pulp or for the chemical industry. These stainless steels are superaustenitic steels, austenoferritic steels or superaustenitic steels with a high nitrogen content. For these applications the superaustenitic steels with a high nitrogen content are the steels that offer the best performance in terms of a combination of mechanical characteristics and of corrosion resistance. They are described in two European Patents: EP-A-0,438,992 and EP-A-0,342,574.

However, these steels (described by EP-A-0,438,992 and EP-A-0,342,574) have disadvantages. On the one hand, while the improvement in the resistance of these steels to corrosion in a chloride medium is effective, the resistance of these new grades to corrosion in polluted or unpolluted concentrated sulphuric media is mediocre, with the result that the suitability of these steels for a multifarious utilization in various corrosive media or those containing different corrosive agents, for example chloride-containing and sulphuric media, is less good than that of previously known steels which, on the other hand, had poorer mechanical characteristics.

Furthermore, when the type of steel described by Patent EP-A-0,438,992 is employed for manufacturing thick components, phenomena of segregation or of precipitation of intermetallic phases appear during the manufacture of these components, and these very markedly deteriorate the mechanical properties, especially impact strength and corrosion behaviour.

The aim of the present invention is to overcome these disadvantages by providing a stainless steel with high mechanical characteristics and especially with an elastic limit higher than 400 MPa and with high resistance to corrosion in chloride media and sulphuric media which are pure or polluted and especially which has a pitting corrosion resistance value PREN=% Cr+3.3% Mo+16% N higher than 50, which has a very good suitability for multifarious use in various corrosive media containing different corrosive agents, for example chloride-containing and sulphuric ones, and which makes it possible to manufacture thick components which have a very good impact strength and corrosion resistance throughout.

To this end, the subject of the present invention is an austenitic stainless steel with a high mechanical characteristic and high corrosion resistance, whose chemical composition comprises, by weight:

$20\% \leqq Cr \leqq 30\%$ $25\% \leqq Ni \leqq 32\%$ $3\% \leqq Mo \leqq 7\%$ $0.35\% \leqq N \leqq 0.8\%$ $0.5\% \leqq Mn \leqq 5.4\%$ $C \leqq 0.06\%$ $Si \leqq 1\%$, the remainder, with the exception of iron, consisting of impurities resulting from the production.

The carbon content is preferably lower than 0.04%. To improve its corrosion resistance, this steel may additionally contain from 0.5% to 3% of copper.

It is preferable that this steel should contain less than 0.010% of sulphur.

It may additionally contain at least one element taken from B, Nb, V, Al in contents which are: B from 0.0001 to 0.003%, Nb from 0.001 to 0.3%, V from 0.01 to 0.3%, Al from 0.001 to 0.1%.

This steel preferably contains:

$23\% \leqq Cr \leqq 28\%$ $25\% \leqq Ni \leqq 28\%$ $4.5\% \leqq Mo \leqq 7\%$.

Still more preferably, the composition of the steel according to the invention is the following:

$25\% \leqq Cr \leqq 26\%$ $25\% \leqq Ni \leqq 26\%$ $6\% \leqq Mo \leqq 7\%$ $0.4\% \leqq N \leqq 0.5\%$ $2.5\% \leqq Mn \leqq 3.5\%$ $C \leqq 0.03\%$ $Si \leqq 0.3\%$, $1\% \leqq Cu \leqq 2\%$, the remainder, with the exception of iron, consisting of impurities resulting from the production.

Finally, the chemical composition of the steel must preferably satisfy the following relationships:

$$95 < kP = \%Cr + 0.3\%Ni + 9\%Si + 27\%Mo + 130\%P - 8\%N < 232$$

and preferably:

$95 < kP < 210$ and $$319 < kC = 3.3\%Cr + 10\%Ni + \%Mo + 1.5\%Cu < 432.$$

and preferably:

$355 < kC < 432$.

Another subject of the invention is the use of the steel according to the invention for the manufacture of equipment for removing pollutants from the fumes of thermal power stations and of plants for the incineration of household waste, especially gas or fume scrubbing towers, gas or fume ducts and chimneys; for the manufacture of equipment for delignification, especially by the bisulphite process, for filtration and for bleaching of paper pulp; for the manufacture of equipment for the chemical industry in a chloride or acidic medium and especially for the manufacture of vessels, storage tanks, reactors, pipes, pump bodies and pump shafts; for the manufacture of offshore platform equipment subjected to corrosion by seawater and/or hydrocarbons and especially flare supports, of heat exchangers, of separators, of tube plates, of pipework for conveying seawater, of pipework employed for conveying hydrocarbons, of components for protecting the regions of pylons situated in the vicinity of the free sea surface, of earth rods, of pump shafts, of connecting flanges, of wellheads, of manifolds and of risers; and for the manufacture of tankers for road or rail transport of highly corrosive chloride-containing or acidic products.

The invention will now be described more precisely but without any limitation being implied.

The austenitic stainless steel according to the invention must contain (contents expressed in % by weight):

chromium: more than 20% to obtain a good localized corrosion resistance and lower than 30% to have kinetics of precipitation of carbides and/or intermetallic phases that are not too fast; preferably, a chromium content of between 23% and 28% and more preferably between 25% and 26% will be chosen;

nickel: more than 25% to obtain a corrosion resistance in very diverse media and especially in pure or polluted sulphuric media and/or acidic gases and less than 32% so as not to lower the nitrogen solubility excessively; preferably, a nickel content of between 25 % and 28% and still more preferably between 25% and 26% will be chosen;

molybdenum: more than 3% to improve the localized corrosion resistance and less than 7% to limit the segregations in thick products, which deteriorate impact strength and corrosion behaviour; preferably a molybdenum higher than 4.5% and more preferably a content higher than 6% will be chosen;

nitrogen: more than 0.35% to obtain a high level of mechanical characteristics, to improve structural stability and to increase the corrosion resistance, and less than 0.8% to avoid deteriorating the impact strength excessively by precipitating nitrides; preferably a nitrogen content of between 0.4% and 0.5% will be chosen;

manganese: more than 0.5% to improve nitrogen solubility and less than 5.4% because an excessively high manganese content deteriorates the structural stability of the steel and damages steel plant refractories during production.

Such a steel must contain less than 0.06% of carbon to prevent the precipitation of carbides at the grain boundaries, which deteriorate the corrosion resistance, and it is preferable to limit this content to 0.04% and, better still, to 0.03%.

The steel always contains a little sulphur, which is good for machinability but which promotes pitting corrosion and it is therefore preferable to have a sulphur content lower than 0.01%.

To improve the corrosion resistance in sulphuric medium and in acidic chloride medium, between 0.5% and 3%, and preferably between 1% and 2% of copper may be added; copper also has the advantage of improving machinability.

To improve the mechanical characteristics, between 0.001% and 0.3% of niobium or vanadium may be added.

To improve malleability and thus to facilitate the hot rolling or hot forging operations it is preferable to add from 0.001% to 0.1% of aluminium and optionally from 0.0001% to 0.003% of boron.

A steel is thus obtained which in its most general form contains:

$20\% \leqq Cr \leqq 30\%$ $25\% \leqq Ni \leqq 32\%$ $3\% \leqq Mo \leqq 7\%$ $0.35\% \leqq N \leqq 0.8\%$ $0.5\% \leqq Mn \leqq 5.4\%$ $C \leqq 0.06\%$ $Si \leqq 1\%$, the remainder, with the exception of iron, consisting of impurities resulting from the production.

It contains preferably less than 0.04% of carbon. This steel has the advantage of simultaneously having:

a high mechanical strength and especially an elastic limit higher than 400 MPa, a good impact strength in particular when it is employed for producing thick or massive components such as thick sheets or forged components, particularly as a result of the molybdenum content limited to a maximum of 7%, good resistance to localized corrosion in chloride medium; it is especially characterized by a pitting value P.R.E.N.=% Cr+3.3% Mo+16% N>50, good resistance to corrosion in media which are at the same time chloride-containing and sulphuric, as a result of its high nickel content (>25%).

A steel whose resistance to corrosion and machinability are improved is obtained by adding from 0.5% to 3% of copper to this steel.

A steel whose mechanical characteristics are improved is obtained when 0.001% to 0.3% of niobium or 0.001% to 0.3% of vanadium is added to the steels defined above.

A steel whose malleability is improved is obtained with a supplementary addition of 0.001% to 0.1% of aluminium and/or of 0.0001% to 0.003% of boron.

The additions of copper, vanadium, niobium, boron and aluminium are optional and may be made by themselves or in combination.

In the case of some properties, the main alloy elements have effects which are proportionately more favourable the higher their content and, in the case of other properties, effects that are less unfavourable the less high the content; it is thus preferable to choose the chemical composition in a composition range which is not too wide. It is therefore preferable, in all cases, to limit the chromium, nickel and molybdenum ranges to:

$23\% \leqq Cr \leqq 28\%$ $25\% \leqq Ni \leqq 28\%$ $4.5\% \leqq Mo \leqq 7\%$.

The inventors have found that the best results are obtained with a steel whose composition is the following:

$25\% \leqq Cr \leqq 26\%$ $25\% \leqq Ni \leqq 26\%$ $6\% \leqq Mo \leqq 7\%$ $0.4\% \leqq N \leqq 0.5\%$ $2.5\% \leqq Mn \leqq 3.5\%$ $1\% \leqq Cu \leqq 2\%$ $C \leqq 0.03\%$ $Si \leqq 0.3\%$.

and, preferably, $S \leqq 0.01\%$, the remainder, with the exception of iron, consisting of impurities resulting from the production.

As indicated above, this steel may additionally contain Nb, V, B or Al.

The inventors have also found that, for these steels to have optimum properties, their chemical compositions must satisfy the following relationships:

to guarantee a low segregation and little precipitation of carbides and/or intermetallic phases:

$$95 < kP = \%Cr + 0.3\%Ni + 9\%Si + 27\%Mo + 130\%P - 8\%N < 232$$

and preferably $95 < kP < 210$ to have a good multifariousness of the corrosion resistance (in particular in pure or polluted sulphuric media and in chloride media):

$$319 < kC = 3.3\%Cr + 10\%Ni + \%Mo + 1.5\%\ Cu < 432$$

and preferably: $355 < kC < 432$.

A steel of the following composition was produced by way o f example:

Cr=25%

Ni=25.5%

Mo=6.5%

N=0.45%

Cu=1.5%

C=0.020%

Si=0.25%

S=0.001% the remainder, with the exception of iron, consisting of impurities resulting from the production.

This steel was manufactured in the form of a bar 500 nun in diameter, obtained after cooling in air. The mechanical chracteristics were the following:

Re=490 MPa

TS=890 MPa

E=57%

Kcv at 20° C.=285 joules

Kcv at −50° C.=280 joules

Kcv at 20° C. at the disc core=250 joules.

This last value is the sign of a very good structural stability.

A test for localized corrosion in a chloride medium according to US ASTM standard G 48 gave a pitting temperature higher than or equal to the boiling temperature.

A test for generalized corrosion in sulphuric medium at a concentration of 10% of $H_2SO_4$ at 80° C., deaerated and contaminated with up to 500 ppm of chlorine did not reveal any corrosion after 96 hours (0 mdd=0 mg/dm$^2$/day) whereas in the case of the grades of the prior state of the art, in the same conditions, the corrosion is of the order of 100 mdd.

This steel has an additional advantage which stems from the fact that the product E×TS of the elongation at break and of the ultimate tensile strength is very high (approximately twice that of the steels of the prior art employed for transport), with the result that the impact strength of the walls produced with this steel is very high and especially much higher than in the case of the steels of the prior art.

This characteristic has the advantage of making it possible to produce tankers, receptacles or pipes for conveying corrosive products that are much safer in the case of impact than the equivalent equipment produced with steels according to the prior art.

The properties of this steel make it particularly suitable for the manufacture of reactors (scrubbers, scrubbing tower, filter vessels, digesters), pipes (welded and seamless), chimneys, joint components such as flanges, manifolds, flow lines, separators and tankers for road or rail transport, for industries in which this equipment is subjected to very severe corrosion by chloride and/or pure or polluted sulphuric media and especially for offshore oil exploitation platforms, for plants for removing pollutants from combustion fumes of thermal power stations or for incinerating household waste, for the preparation of paper pulp, in particular by the so-called "bisulphite" process, and especially for filtration, bleaching and delignification equipment, for the chemical industry and more particularly for hydrometallurgy equipment and for the fertilizer industry making use of the digestion of ores with concentrated sulphuric media.

More particularly:

in offshore platforms for the exploitation of underwater petroleum or gas fields the steel according to the invention is employed for producing process equipment subject to corrosion by seawater, especially flare supports, heat exchangers and separators and, especially, tube plates, pipework for conveying seawater and pipework employed for the processing of oil or of gas, protection for the region of the pylons which is in the vicinity of the free sea surface, earth rods, pump shafts and connecting flanges subjected to corrosion by sea-water, wellheads, manifolds and risers;

in the pollutant removal industries, for producing equipment subjected to corrosion either by hydrochloric acid or by sulphuric acid or by mixtures of these acids, sometimes in the presence of hydrofluoric acid, and especially for the production of scrubbing towers for gases or combustion fumes from thermal power stations and waste incineration plants, and for the manufacture of the ducts leading to the chimneys; in the particular case of scrubbing towers for gases from a thermal power station, the equipment is, in particular: the reactor, the presaturator, the internal structure of the absorber and the chimney;

in the paper pulp industry for the manufacture of delignification equipment in particular using the bisulphite process and of equipment for filtration and bleaching with highly oxidizing chlorine compounds such as $Cl_2$ and $ClO_2$ and also with compounds of the hydrogen peroxide and ozone type; in the delignification, this is especially the preheaters, digesters, impregnators and continuous digesters; in scrubbing and bleaching, this is especially the scrubber, the filtration trough, the tower for bleaching with chlorine and chlorine dioxide and its distributing, scrubbing and filtration equipment and the hypochlorite bleaching tower with its scrubber and its filtration trough;

in the chemical industry the steel according to the invention can be advantageously employed for producing especially troughs, storage vessels, reactors, pipes, pump bodies and pump shafts which are in contact with highly chloride-containing media or acidic media.

This steel also makes it possible to produce any component subjected to abrasion/corrosion in chloride and/or acidic media.

For all these applications, in fact, a person skilled in the art is continuously searching for the steel which has the best possible mechanical characteristics and the highest possible corrosion resistance without, however, its price being exorbitant, in order to produce equipment which is as reliable as possible and which has the longest possible lifetime, this being at a cost compatible with its industrial use. As a result of its chemical composition and its properties, the steel according to the invention is much more advantageous from this point of view than nickel-based superalloys.

The applications described do not imply any limitation and a person skilled in the art will be capable of choosing this steel when he or she deems it useful.

We claim:

1. An austenitic stainless steel with high mechanical strength and corrosion resistance comprising iron, and, by weight:

$20\% \leqq Cr \leqq 30\%$ $25\% \leqq Ni \leqq 32\%$ $6\% \leqq Mo \leqq 7\%$ $0.35\% \leqq N \leqq 0.8\%$ $0.5\% \leqq Mn \leqq 5.4\%$ $C \leqq 0.06\%$ $Si \leqq 1\%$ optionally $0.5\% \leqq Cu \leqq 3\%$ optionally $0.001\% \leqq Nb \leqq 0.3\%$ optionally 0.001%≦V≦0.3% optionally 0.001%≦Al≦0.1% optionally 0.0001%23 B≦0.003% and impurities resulting from production and having a PREN=% Cr+3.3 (% Mo)+16 (% N)≧50.

2. The austenitic stainless steel as in claim 1 with high mechanical strength and corrosion resistance comprising iron, and, by weight:

20%≦Cr≦30%

25%≦Ni≦32%

6%≦Mo≦7%

0.4%≦N≦0.5%

0.5%≦Mn≦5.4%

C≦0.06%

Si≦1% optionally 0.5%≦Cu≦3% optionally 0.001%≦Nb≦0.3% optionally 0.001%≦V≦0.3% optionally 0.001%≦Al≦0.1% optionally 0.0001%≦B≦0.003% and impurities resulting from production and having a PREN=% Cr+3.3 (% Mo)+16 (% N)≧50.

3. The austenitic stainless steel as claimed in claim 1 with high mechanical strength and corrosion resistance comprising iron, and, by weight:

25%≦Cr≦26%

25%≦Ni≦26%

6%≦Mo≦7%

0.4%≦N≦0.5%

0.5%≦Mn≦5.4%

C≦0.03%

Si≦0.03% optionally 1%≦Cu≦2% optionally 0.001%≦Nb≦0.3% optionally 0.001%≦V≦0.3% optionally 0.001%≦A≦0.1% optionally 0.0001%≦B≦0.003% and impurities resulting from production and having a PREN=% Cr+3.3 (% Mo)+16 (% N)≧50.

4. An austenitic stainless steel with high mechanical strength and corrosion resistance comprising iron and, by weight, 25%≦Cr≦26%

25%≦Ni≦26%

6%≦Mo≦7%

0.4%≦N≦0.5%

2.5%≦Mn≦3.5%

1%≦Cu≦2%

C≦0.03%

Si≦0.3% and optionally, 0.001%≦Nb≦0.3% and impurities resulting from production.

5. An austenitic stainless steel as claimed in claim 1 consisting of iron and, by weight, 25%≦Cr≦26%

25%≦Ni≦26%

6%≦Mo≦7%

0.4%≦N≦0.5%

2.5%≦Mn≦3.5%

1%≦Cu≦2%

C≦0.03%

Si≦0.3% and optionally, 0.001%≦Nb≦0.3% and impurities resulting from production.

6. An austenitic stainless steel as claimed in claim 4 which comprises less than 0.01 wt % S.

* * * * *